US009670023B2

(12) United States Patent
Liang et al.

(10) Patent No.: US 9,670,023 B2
(45) Date of Patent: Jun. 6, 2017

(54) TEMPORARY STORAGE DEVICE FOR SHEET MEDIUM

(71) Applicant: GRG Banking Equipment Co., Ltd., Guangzhou, Guangdong (CN)

(72) Inventors: Guoyou Liang, Guangdong (CN); Hongjun Wu, Guangdong (CN)

(73) Assignee: GRG Banking Equipment Co., Ltd., Guangzhou, Guangdong (CN)

( * ) Notice: Subject to any disclaimer, the term of this patent is extended or adjusted under 35 U.S.C. 154(b) by 103 days.

(21) Appl. No.: 14/767,328

(22) PCT Filed: Jul. 3, 2013

(86) PCT No.: PCT/CN2013/078735
§ 371 (c)(1),
(2) Date: Aug. 12, 2015

(87) PCT Pub. No.: WO2014/134892
PCT Pub. Date: Sep. 12, 2014

(65) Prior Publication Data

US 2016/0009517 A1 Jan. 14, 2016

(30) Foreign Application Priority Data

Mar. 7, 2013 (CN) ..... 2013 1 0072988

(51) Int. Cl.
*G07D 11/00* (2006.01)
*B65H 29/00* (2006.01)
*B65H 5/28* (2006.01)

(52) U.S. Cl.
CPC ..... *B65H 29/006* (2013.01); *B65H 5/28* (2013.01); *G07D 11/00* (2013.01);
(Continued)

(58) Field of Classification Search
CPC ..... B65H 29/006; B65H 29/008
See application file for complete search history.

(56) References Cited

U.S. PATENT DOCUMENTS 3,896,691 A 7/1975 Granger et al.
5,599,013 A 2/1997 Detmers et al.
(Continued)

FOREIGN PATENT DOCUMENTS

CN 1082489 A 2/1994
CN 101278082 A 10/2008
(Continued)

OTHER PUBLICATIONS

Chinese Office Action, dated Dec. 2, 2014, from corresponding or related Chinese Patent Application No. 201310072988.8.
(Continued)

*Primary Examiner* — Gene Crawford
*Assistant Examiner* — Ayodeji Ojofeitimi
(74) *Attorney, Agent, or Firm* — Wolf, Greenfield & Sacks, P.C.

(57) ABSTRACT

A sheet-like medium temporary storage device includes a storage coiling block, configured to reel up and store sheet-like medium and being a circular roller with a cavity at the center; a thin coiling tape, having one end fixedly connected to an outer surface of the storage coiling block and configured to reel up the sheet-like medium and wind the sheet-like medium around the storage coiling block; a recycling coiling block, configured to reel up and recycle the thin coiling tape, wherein another end of the thin coiling tape is fixed to an outer surface of the recycling coiling block; and a power motor arranged in the cavity and configured to drive the storage coiling block to rotate and control the recycling coiling block to rotate. One end of the cavity is opened, and at least two air disturbance vanes are uniformly arranged at another end of the cavity.

5 Claims, 4 Drawing Sheets

(52) U.S. Cl.
CPC ..... *B65H 2301/413* (2013.01); *B65H 2301/41912* (2013.01); *B65H 2301/5305* (2013.01); *B65H 2701/1912* (2013.01)

(56) References Cited

U.S. PATENT DOCUMENTS

| | | | |
|---|---|---|---|
| 2002/0162775 | A1 | 11/2002 | Saltsov et al. |
| 2005/0017428 | A1 | 1/2005 | Ichikawa et al. |
| 2010/0058727 | A1 | 3/2010 | Wassenhoven |
| 2011/0073611 | A1 | 3/2011 | Tosaka et al. |
| 2011/0093116 | A1 | 4/2011 | Nunn |

FOREIGN PATENT DOCUMENTS

| | | | |
|---|---|---|---|
| CN | 102066222 | A | 5/2011 |
| CN | 201952069 | U | 8/2011 |
| CN | 103144993 | A | 6/2013 |
| EP | 2 211 313 | A2 | 7/2010 |
| WO | WO 2009/003152 | A1 | 12/2008 |

OTHER PUBLICATIONS

Extended European Search Report, dated Jun. 6, 2016, from related European Patent Application 13877045.8.
International Search Report from corresponding International Application No. PCT/CN2013/078735 dated Dec. 12, 2013.

TEMPORARY STORAGE DEVICE FOR SHEET MEDIUM

This application is the national phase of International Application No. PCT/CN2013/078735, titled "TEMPORARY STORAGE DEVICE FOR SHEET MEDIUM", filed on Jul. 3, 2013, which claims the benefit of priority to Chinese Patent Application No. 201310072988.8 titled "SHEET-LIKE MEDIUM TEMPORARY STORAGE DEVICE", filed with the Chinese State Intellectual Property Office on Mar. 7, 2013, each of which applications is incorporated herein by reference to the maximum extent allowable by law.

TECHNICAL FIELD

The present application relates to a sheet-like medium processing device, and particularly to a temporary storage device which is used in financial self-service equipment to temporarily store valuable documents.

BACKGROUND

For piece-by-piece verifying sheet-like valuable documents which are processed in batch in the financial self-service equipment, stacked sheet-like valuable documents are required to be separated piece by piece, and then the separated single sheet of sheet-like valuable documents is processed by image identification, thickness detection, magnetic information detection or other identification means, to ensure the authenticity of the processed sheet-like valuable documents. During the whole processing process, the sheet-like valuable documents after being identified is temporarily stored, and after all the valuable documents are identified, the temporarily stored valuable documents are released and conveyed to a designated place.

One kind of temporary storage device in the current banknote processing device employs a thin coiling tape to wind banknotes tightly around a storage coiling block, to enable the banknotes to overlap with each other, thereby realizing a banknote storage function. The storage coiling block is rotatable, and may respectively realize the banknotes accommodating function and the banknotes discharging function with different rotating directions. A power source for the rotation of the storage coiling block is a motor.

A common method for simplifying structure arrangement and reducing installation space is to arrange the motor inside the storage coiling block. In this case, the storage coiling block covers the outer surface of the motor and isolates the motor from the external environment. The motor generates a large amount of heat during operation, and heat diffusion of the motor is hindered due to the coverage and isolation of the storage coiling block, thus the temperature of the motor is increased, which may adversely affect the operation and service life of the motor. Therefore, it is urgent to provide an effective solution to solve the heat diffusion problem of a built-in motor.

SUMMARY

For solving the problem in the conventional sheet-like medium temporary storage device that the temperature of a motor is increased since the diffusion of heat, generated in operation, of the motor is hindered by the coverage of a coiling block on the surface of the motor, a technical solution is provided according to the present application, which changes the structure of a storage coiling block to add a function of vanes without adding parts and increasing structure space, to utilize the rotation of the storage coiling block in operation to generate flow of airflow inside the storage coiling block to form air convection, to positively take away the heat on the surface of the motor, thereby changing the heat dissipation of the motor from passive heat dissipation through air radiation to positive heat dissipation through air convection.

A sheet-like medium temporary storage device according to the present application includes:

a storage coiling block, configured to reel up and store sheet-like medium and being a circular roller with a cavity at the center;

a thin coiling tape, which has one end fixedly connected to an outer surface of the storage coiling block and is configured to reel up the sheet-like medium and wind the sheet-like medium around the storage coiling block, to temporarily store the sheet-like medium;

a recycling coiling block, configured to support the thin coiling tape and reel up and recycle the thin coiling tape, wherein another end of the thin coiling tape is fixed to an outer surface of the recycling coiling block; and a power motor, which is arranged in the cavity of the storage coiling block and configured to drive the storage coiling block to rotate and control the recycling coiling block to rotate through a belt; and wherein one end of the cavity in the center of the storage coiling block is opened to allow the power motor to be insertedly mounted in the storage coiling block, at least two air disturbance vanes are uniformly arranged at another end of the cavity, the air disturbance vanes extend from an outer wall to an axis of the storage coiling block and form a support frame of the power motor around the axis of the storage coiling block, and a clearance is formed between the air disturbance vanes, to ensure air exchange between inside and outside of the storage coiling block in the case that the storage coiling block rotates.

Preferably, the number of the air disturbance vanes is four, and the four air disturbance vanes are uniformly distributed on an end surface of the storage coiling block.

Preferably, the air disturbance blades form an irregular Z-shaped trend along a circumferential direction.

Preferably, two of the thin coiling tapes are provided, two of the recycling coiling blocks are correspondingly provided, the two thin coiling tapes are respectively wound around the two recycling coiling blocks, another ends of the two thin coiling tapes are stacked and fixed on the outer surface of the storage coiling block, and parts of the two thin coiling tapes between the recycling coiling blocks and the storage coiling block form a clamping state.

Compared with the conventional technology, the sheet-like medium temporary storage device has the following advantages.

The storage coiling block of the sheet-like medium temporary storage device is designed with positive heat diffusion vanes. This design has a simple structure, may solve the existing problem without adding parts, and does not need to increase the structure space of the device, thereby facilitating miniaturizing the device.

Figure 1:
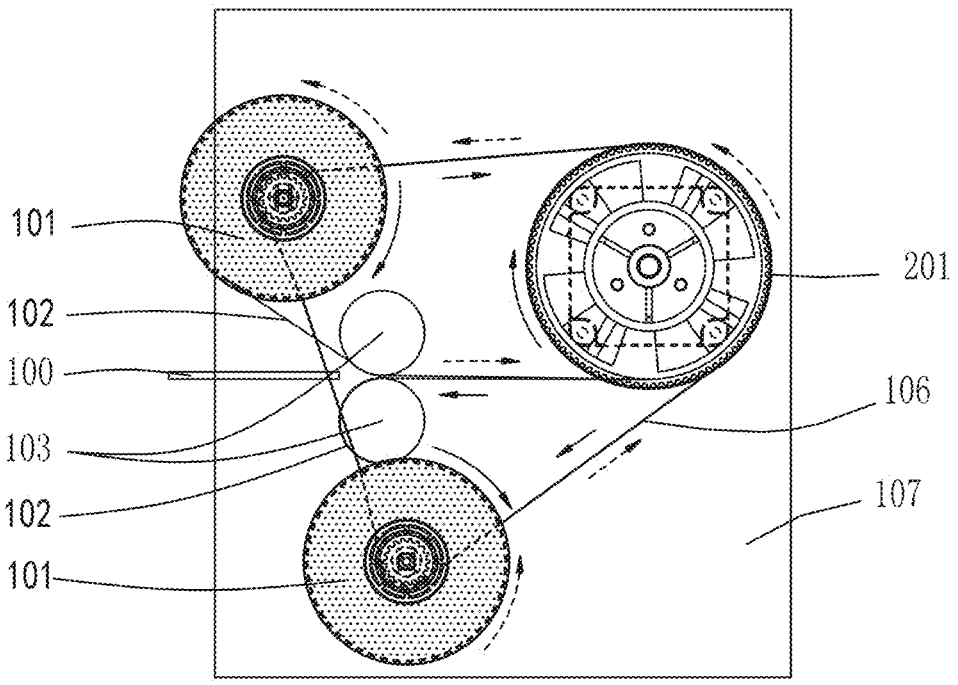
FIG. 1 is a schematic view showing a sheet-like medium temporary storage device according to the present application.

Reference numerals:

| | | | |
|---|---|---|---|
| 100 | sheet-like medium (including but not limited to banknote, check, security and other valuable documents, which is collectively referred to as banknote for convenience), | | |
| 101 | recycling coiling block; | 102 | thin coiling tape, |
| 103 | guide shaft of the thin coiling tape, | 104 | small driving wheel, |
| 105 | big driving wheel, | 106 | driving belt, |
| 107 | mounting plate, | 108 | coiling block rotation shaft, |
| 201 | storage coiling block, | 202 | power motor, |
| 301 | motor supporting frame, | 302 | air disturbance vane, |
| 303 | storage zone of the coiling block, | $V_k$ | air speed of a driving air port, |
| $V_r$ | air speed in a heat-dissipating passage of the motor, | | |
| $d_1$ | diameter of a handle of the coiling block, | | |
| $d_2$ | width of a cross section of the power motor, | | |
| $S_1$ | cross sectional area of the interior of the coiling block, | | |
| $S_2$ | cross sectional area of the handle of the coiling block, | | |
| $S_3$ | cross sectional area of the power motor, | | |
| $S_k$ | area of the driving air port, | | |
| $S_r$ | area of heat-dissipating passage of the motor. | | |

DETAILED DESCRIPTION

In order to further illustrate the sheet-like medium temporary storage device according to the present application, the sheet-like medium temporary storage device of the present application is described hereinafter in detail in conjunction with a preferable embodiment and drawings.

Figure 2:
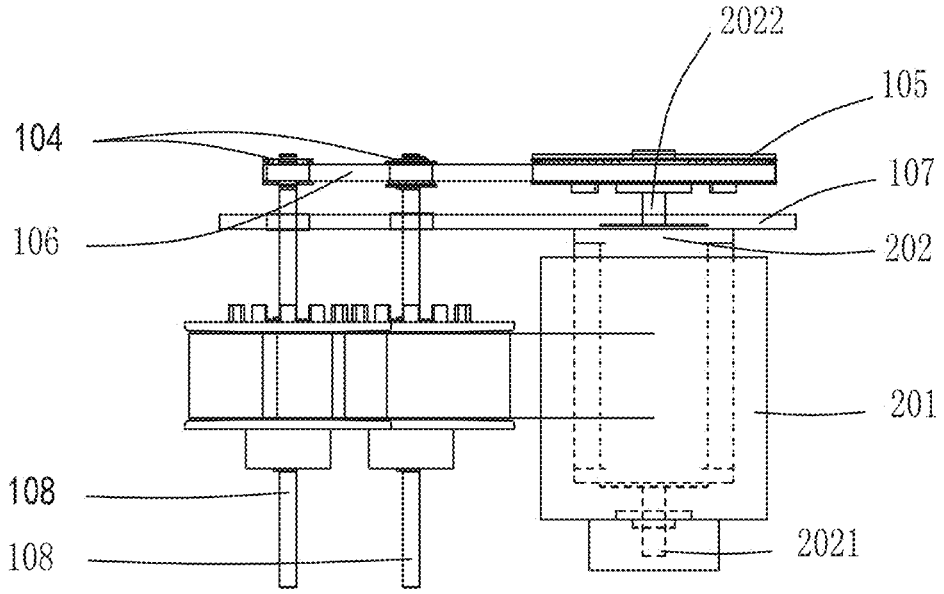
FIG. 2 is a top view of the device shown in FIG. 1.

FIGS. 1 and 2 are schematic views of a sheet-like medium temporary storage device of the present application. The sheet-like medium temporary storage device includes a storage coiling block 201 which is configured to wind and store a sheet-like medium 100 and is embodied as a circular roller with a cavity in the center, a thin coiling tape 102, a recycling coiling block 101 and a power motor 202 arranged in the cavity of the storage coiling block 201. The thin coiling tape 102 is configured to wind the sheet-like medium 100 around the storage coiling block 201 to be temporarily stored, has one end fixedly connected to an outer surface of the storage coiling block 201, and another end fixed to an outer surface of the recycling coiling block 101. The recycling coiling block 101 is configured to support the thin coiling tape 102 and to reel up and recycle the thin coiling tape 102. The power motor 202 has a first power output shaft 2021, and the storage coiling block 201 is driven by the first power output shaft 2021 to rotate. The power motor 202 further has a second power output shaft 2022, a big driving wheel 105 is fixed on the second power output shaft 2022, and the big driving wheel 105 is driven by the second power output shaft 2022 to rotate, and the power of the big driving wheel 105 is used to drive the recycling coiling block 101 via a driving belt 106. The recycling coiling block 101 has a coiling block rotation shaft 108, one end of the coiling block rotation shaft 108 is provided with a small driving wheel 104, and the driving belt 106 is wound around the small driving wheel 104 and the big driving wheel 105. To fixedly mount the sheet-like medium temporary storage device, the device further includes a mounting plate 107, and the second power output shaft 2022 and the coiling block rotation shaft 108 are rotatably mounted on the mounting plate 107.

The sheet-like medium temporary storage device according to the present embodiment includes two recycling coiling blocks 101, and two corresponding thin coiling tapes 102 and two corresponding small driving wheels 104. The two thin coiling tapes 102 are configured to clamp the sheet-like medium 100 and wind the sheet-like medium 100 around the storage coiling block 201, to temporarily store the sheet-like medium 100. The two small driving wheels 104 are respectively arranged on two coiling block rotation shafts 108 which are rotatably arranged on the mounting plate 107, and the driving belt 106 is mounted on the big driving wheel 105 and the two small driving wheels 104 and is configured to transmit power between the big driving wheel 105 and the two small driving wheels 104.

Each of the two thin coiling tapes 102 has sufficient length, and has one end mounted on the respective recycling coiling block 101, and another end mounted on the storage coiling block 201 after passing through a respective guiding shaft 103 of the thin coiling tape, and the remaining length of each of the two thin coiling tapes is wound around the recycling coiling block 101 to be reserved.

Figure 3:
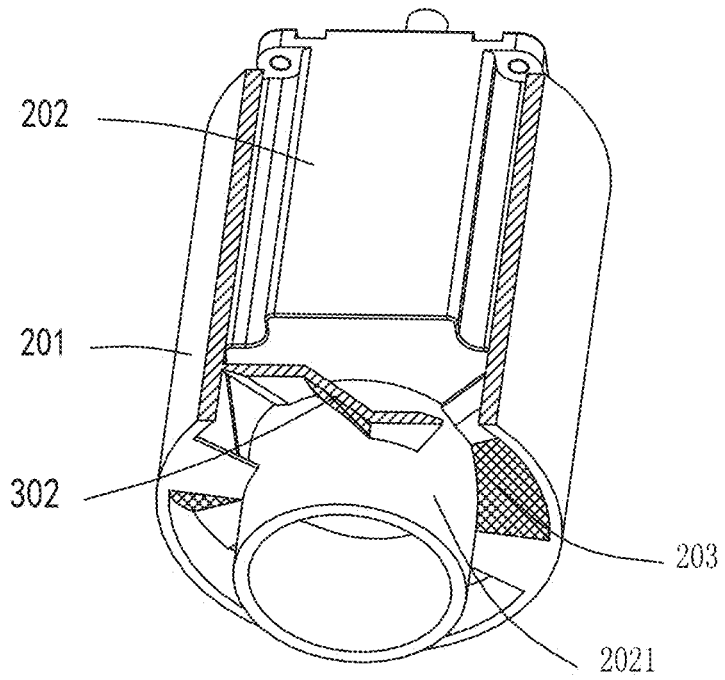
FIG. 3 is a partially sectional view showing the cooperation of a storage coiling block and a motor of the device in FIG. 1.
Figure 4:
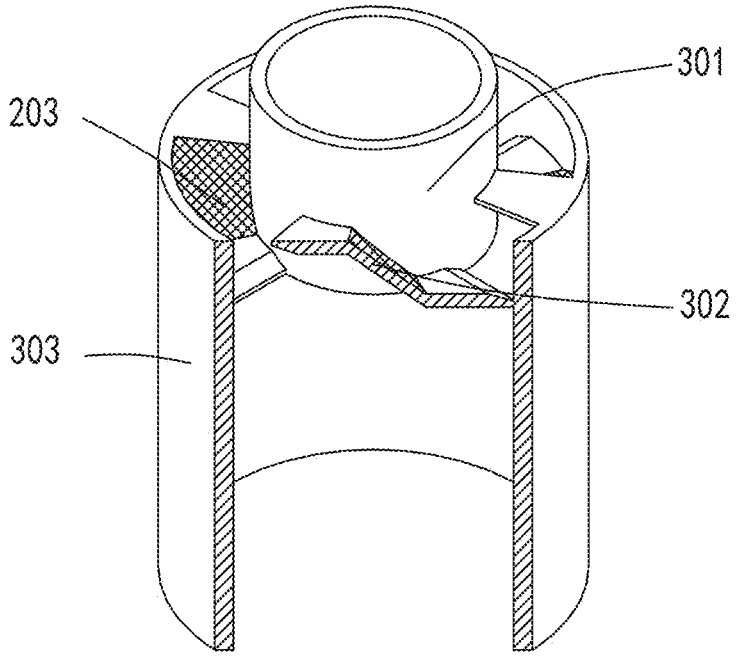
FIG. 4 is a partially sectional view of the storage coiling block of the device in FIG. 1.

Referring to FIGS. 3 and 4, one end of the cavity at the center of the storage coiling block 201 is opened, the storage coiling block 201 is fixedly arranged on the first power output shaft of the power motor 202, and covers the surface of the power motor 202 and is rotatable. Four air disturbance vanes 302 are uniformly arranged on another end of the cavity at the center of the storage coiling block 201, and extend from an outer wall 303 toward the axis of the storage coiling block, to form a power motor supporting frame 301 around the axis of the storage coiling block. Each of the air disturbance vanes 302 forms an irregular Z-shaped trend along the circumferential direction, and clearances are formed between the adjacent air disturbance vanes 302, to ensure air exchange inside and outside the storage coiling block 201 when the storage coiling block 201 rotates, and the clearances form a driving air port 203.

Figure 5:
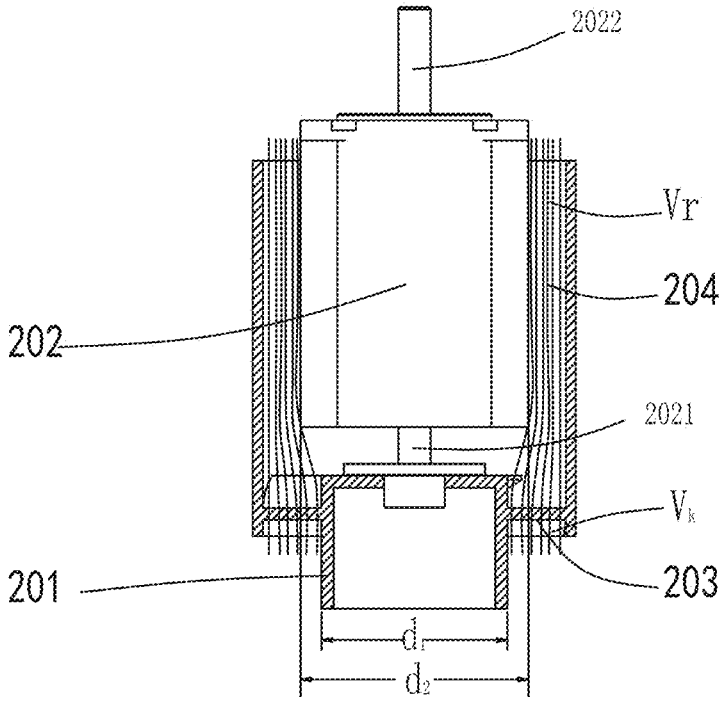
FIG. 5 is a schematic view showing an air passage when the storage coiling block of the device in FIG. 1 rotates.
Figure 6:
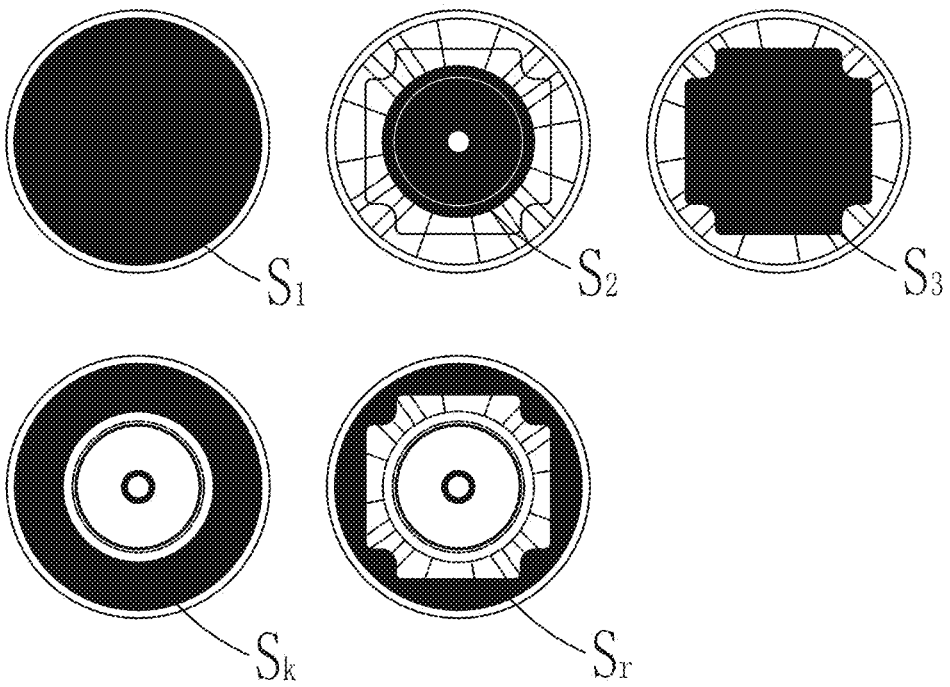
FIG. 6 is a schematic view showing internal cross-sectional areas of the storage coiling block of the device in FIG. 1.

The condition of the air passage when the storage coiling block rotates is further illustrated in conjunction with FIG. 5. When the storage coiling block 201 is driven by the power motor 202 to rotate, the air disturbance vanes 302 on the storage coiling block 201 drives air to flow, the air passes through a heat-dissipating passage 204 formed between the surface of the power motor 202 and the inner surface of the storage coiling block 201 and takes away the heat at the surface of the motor. A flow speed of the air at the driving air port 203 of the storage coiling block 201 is $V_k$, and a flow speed of the air in the heat-dissipating passage 204 on the surface of the power motor 202 is $V_r$. As shown in FIG. 5, which is a schematic view showing cross sectional areas of the interior of the storage coiling block 201, an internal cross sectional area of the storage coiling block 201 is $S_1$, a cross sectional area of the motor supporting frame is $S_2$, and a cross sectional area of the power motor is $S_3$. A width $d_2$ of the cross section of the power motor is greater than a width $d_1$ of the motor supporting frame 301, thus $S_3>S_2$. As shown in the figure, an area $S_k$ of the driving air port 203 of the storage coiling block 201 satisfies an expression of $S_k=S_1-S_2$, an area $S_r$ of the heat-dissipating passage 204 satisfies an expression of $S_r=S_1-S_3$, therefore, the relationship between the area $S_k$ of the driving air port 203 and the area $S_r$ of the heat-dissipating passage 204 satisfies an expression of $S_k>S_r$. The relationship between the flow speed $V_r$ of the air in the heat-dissipating passage 204 and the flow speed $V_k$ of the air at the driving air port 203 satisfies an expression of $V_r=V_k\times(S_k/S_r)>V_k$. The flow speed of the airflow formed at the driving air port 203 is increased when passing through the heat-dissipating passage 204 due to the decrease of the passage section, thereby expediting the heat dissipation on the surface of the motor.

Figure 7:
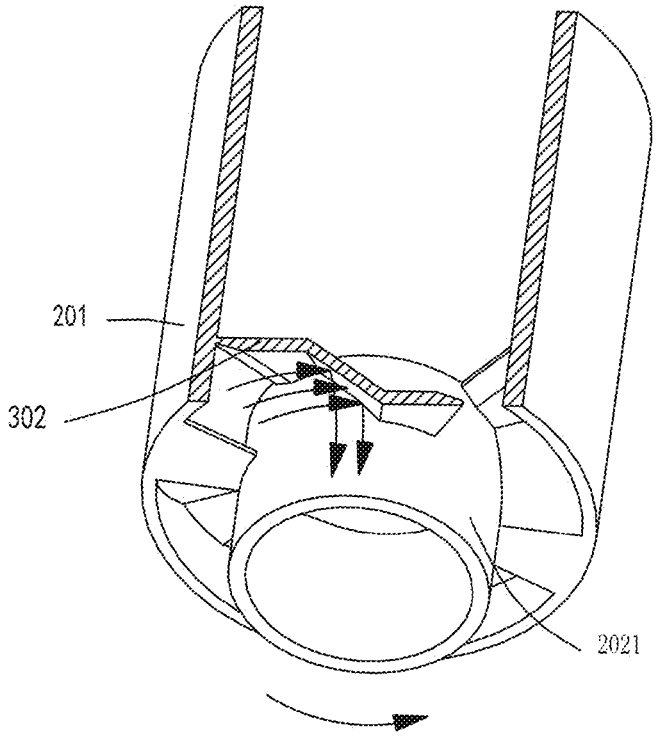
FIG. 7 is a schematic view showing the wind direction when the storage coiling block of the device in FIG. 1 rotates in a positive direction.
Figure 8:
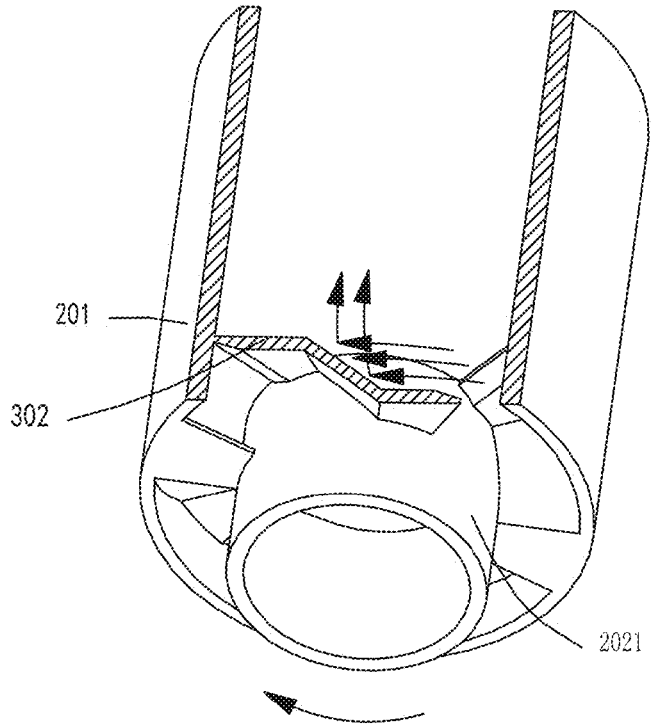
FIG. 8 is a schematic view showing the wind direction when the storage coiling block of the device in FIG. 1 rotates in a reverse direction.

Referring to FIGS. 7 and 8, the directions of air exchange when the storage coiling block 201 rotates positively or reversely is further illustrated. In this embodiment, the air is drawn from the heat-dissipating passage when the power motor 202 rotates in a positive direction, and an inclining direction of the air disturbance vanes 302 is the positive direction. Of course, an arrangement direction of the vanes may be positive direction or reverse direction according to different inclining directions of the air disturbance vanes 302, both of which may realize the object of the present application.

A heat dissipation process of the power motor when the sheet-like medium temporary storage device is operating is further illustrated in conjunction with FIGS. 1 to 8. When a sheet-like medium 100 is sent into the sheet-like medium temporary storage device, a sheet inlet formed between the two guiding shafts 103 of the thin coiling tapes and the two thin coiling tapes 102 is configured to receive the sheet-like medium 100, the power motor 202 drives the storage coiling block 201 and the big driving wheel 105 to rotate in the positive direction, the big driving wheel 105 then drives the two small driving wheels 104 to rotate in the positive direction via the drive belt 106, and the two small driving wheels 104 respectively drive two recycling coiling blocks 101 to rotate in the positive direction through two small coiling block rotation shafts 108, and the two recycling coiling blocks 101 respectively release the two thin coiling tapes 102 pre-stored on the two recycling coiling blocks 101 step by step, to wind the sheet-like medium clamped between the two thin coiling tapes 102 around the storage coiling block 201, thereby accomplishing a storage process of the sheet-like mediums. In the above process, the air disturbance vanes 302 at one end of the storage coiling block 201 rotates around the first power output shaft of the power motor when the storage coiling block 201 rotates. Due to the inclined arrangement of the air disturbance vanes, the inclined surfaces of the air disturbance vanes strike air particles when the air disturbance vanes rotate, which accelerates the movement of the air particles and changes the movement direction of the air particles, and an airflow flowing from the heat-dissipating passage 204 toward the driving air port 203 is formed. Due to the airflow, heat in the heat-dissipating passage 204 generated by the operation of the power motor 202 is taken away by the air in contact with the heat-dissipating passage 204, thereby realizing the object of fast cooling of the power motor.

Conversely, when the power motor 202 rotates in the reverse direction, the storage coiling block 201 and the big driving wheel 105 are driven to rotate in the reverse direction, the two thin coiling tapes 102 clamping the sheet-like medium 100 are released from the storage coiling block 201, and the two recycling coiling blocks 101 recycle the thin coiling tapes 102 step by step, to release the clamped sheet-like medium piece by piece, thereby accomplishing a discharging function of the sheet-like mediums temporarily stored on the storage coiling block 201. In the above process, the air disturbance vanes 302 at one end of the storage coiling block 201 rotates around the first power output shaft of the power motor when the storage coiling block 201 rotates in the reverse direction. Due to the inclined arrangement of the air disturbance vanes, the inclined surfaces of the air disturbance vanes strike air particles when the air disturbance vanes rotate, which accelerates the movement of the air particles and changes the movement direction of the air particles, and an airflow flowing from the driving air port 203 toward the heat-dissipating passage 204 is formed. Due to the airflow, heat in the heat-dissipating passage 204 generated by the operation of the power motor 202 is taken away by the air in contact with the heat-dissipating passage 204, thereby realizing the object of fast cooling of the power motor.

Besides, the air disturbance vanes 302, that is the vanes of the coiling block, are arranged obliquely, and a ventilation space is provided between each two adjacent air disturbance vanes 302, thus even if the power motor stops rotating, that is the storage coiling block 201 stops rotating, heat generated inside the storage coiling block 201 during the operation of the power motor 202 may also be dissipated from these ventilation spaces in a manner of heat convection, which accelerates the natural cooling of the power motor.

The embodiments described hereinabove are only preferable implementations of the present application, and are not intended to limit the present application, and the scope of the present application is defined by the claim. For the person skilled in the art, a few of modifications and improvements may be made to the present application without departing from the principle of the present application, and these modifications and improvements are also deemed to fall into the scope of the present application.

The invention claimed is:

1. A sheet-like medium temporary storage device, comprising:

a storage coiling block, configured to reel up and store sheet-like medium and being a circular roller with a cavity at the center;

a thin coiling tape, which has one end fixedly connected to an outer surface of the storage coiling block and is configured to reel up the sheet-like medium and wind the sheet-like medium around the storage coiling block, to temporarily store the sheet-like medium;

a recycling coiling block, configured to support the thin coiling tape and reel up and recycle the thin coiling tape, wherein another end of the thin coiling tape is fixed to an outer surface of the recycling coiling block; and a power motor, which is arranged in the cavity of the storage coiling block and configured to drive the storage coiling block to rotate and control the recycling coiling block to rotate through a belt; and wherein one end of the cavity in the center of the storage coiling block is opened to allow the power motor to be insertedly mounted in the storage coiling block, at least two air disturbance vanes are uniformly arranged at another end of the cavity, the air disturbance vanes extend from an outer wall to an axis of the storage coiling block and form a support frame of the power motor around the axis of the storage coiling block, and a clearance is formed between the air disturbance vanes, to ensure air exchange between inside and outside of the storage coiling block in the case that the storage coiling block rotates.

2. The sheet-like medium temporary storage device according to claim 1, wherein the number of the air disturbance vanes is four, and the four air disturbance vanes are uniformly distributed on an end surface of the storage coiling block.

3. The sheet-like medium temporary storage device according to claim 1, wherein the air disturbance blades form an irregular Z-shaped trend along a circumferential direction.

4. The sheet-like medium temporary storage device according to claim 1, wherein two of the thin coiling tapes are provided, two of the recycling coiling blocks are correspondingly provided, the two thin coiling tapes are respectively wound around the two recycling coiling blocks, another ends of the two thin coiling tapes are stacked and fixed on the outer surface of the storage coiling block, and parts of the two thin coiling tapes between the recycling coiling blocks and the storage coiling block form a clamping state.

5. The sheet-like medium temporary storage device according to claim 2, wherein the air disturbance blades form an irregular Z-shaped trend along a circumferential direction.

* * * * *